United States Patent [19]

Harter

[11] 4,297,792

[45] Nov. 3, 1981

[54] MODIFIED JAR DRYER

[75] Inventor: Elton H. Harter, San Jose, Costa Rica

[73] Assignee: Gerber Products Company, Fremont, Mich.

[21] Appl. No.: 140,917

[22] Filed: Apr. 16, 1980

[51] Int. Cl.[3] ..... F26B 3/24

[52] U.S. Cl. ..... 34/12; 34/39; 34/105; 34/95.3; 15/70

[58] Field of Search ..... 34/104, 105, 39, 12, 34/95, 95.3; 15/21 D, 88, 56, 59, 70

[56] References Cited

U.S. PATENT DOCUMENTS 1,529,651 3/1925 Eberhart ..... 15/70

2,597,946 5/1952 Olson ..... 15/70

*Primary Examiner*—Larry I. Schwartz

[57] ABSTRACT

A rotating brush jar dryer is disclosed having the outer ends of the brush bristles heated by brushing across a heater element during operation. In bottling operations, prior to applying labels to the jars or bottles the outside surfaces of the jars must be dried. This is often accomplished using a cylindrical rotating brush whose bristles wipe across the surface of a series of jars as the jars are moved past the brush on a conveyor. In the present invention a heating element is positioned parallel to the rotating brush so that the bristles are heated as they brush across the heating element thereby increasing the drying effectiveness of the unit.

10 Claims, 2 Drawing Figures

MODIFIED JAR DRYER

This invention is related to dryers, particularly the type which use a rotating brush to wipe across the surface of a series of jars as they pass in a direction parallel to the rotational axis of the brush.

BACKGROUND OF THE INVENTION

Prior to applying labels on jars, cans, or other containers, the containers are often washed and then dried. Many commercial jar washers also have a final stage for drying the outside surfaces of the jars as they pass along a conveyor. One type of prior art bottle dryer has a relatively long cylindrical rotating brush mounted above the conveyor so that as the jars are rolled down the conveyer, the bristles of the rotating brush wipe away the water on their exterior surface. In conjunction with the rotating brush, the dryer stage of prior art bottle washers often use one or more air streams directed at the jars to finish drying them. The supplemental forced air drying apparatus has two main drawbacks. Using compressors and air blowers to finish drying the jars is relatively energy inefficient. Also, a great amount of noise is produced along the bottling line by the compressors, blowers and air nozzles typically used. Further, in many plants the bottle or jar drying portion of the labeling line is the limiting factor in the speed at which the plant can operate. By speeding up the drying process, greater plant speed and efficiency can be achieved.

SUMMARY OF THE INVENTION

The present invention provides an improvement on prior art jar dryers by directly heating the bristles of the rotating brush to quickly and efficiently dry the jars.

The rotating brush jar dryer of the present invention has a cylindrical rotating brush mounted above and generally parallel to a conveyor line along which a series of newly washed bottles pass. The bristles of the brush wipe across the surface of the jars as they pass the brush. As used in this application the term "bristles" is intended to include, but not be limited to, bristles which are either stiff or limp in character and may be produced from a single strand of material, a multifiberous strand, and a length of woven cloth or the like. A heating element is positioned parallel to and touching the rotating bristles so that the bristles are heated as they brush across the heating element. The provision of a heating element to heat the bristles increases the drying effectiveness of the unit in an efficient and quiet manner. The mechanical contact of the bristles with the heating element also helps to remove water from the bristles as the bristles spring back upon disengagement from the heater.

The jar dryer of the present invention has three primary advantages over the prior art rotating brush dryers. First, the noise level along the labeling line is greatly reduced, thus markedly improving the working conditions in that area. Second, the energy used to dry the jars is reduced significantly because the energy required for the heating element is much less than would be required by the compressors and blowers which would otherwise be used. The heating element is constructed so that a significant portion of the heat released by the heating element is used to heat the bristles of the rotating brush. Third, the jar dryer of the invention dries the jars faster thus increasing the speed of the labeling line. This contributes to the more efficient operation of the plant with a minimal investment in equipment.

Other advantages of the present invention will be apparent from the following description of the preferred embodiment which is set forth in detail in conjunction with the accompanying drawings.

DETAILED DESCRIPTION OF THE PREFERRED EMBODIMENT

Figure 2:
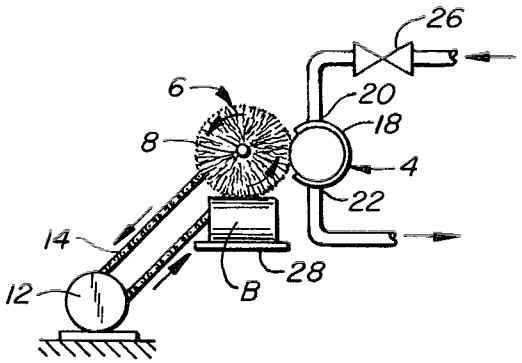
FIG. 2 is an end view of the jar dryer shown in FIG. 1.
Figure 1:
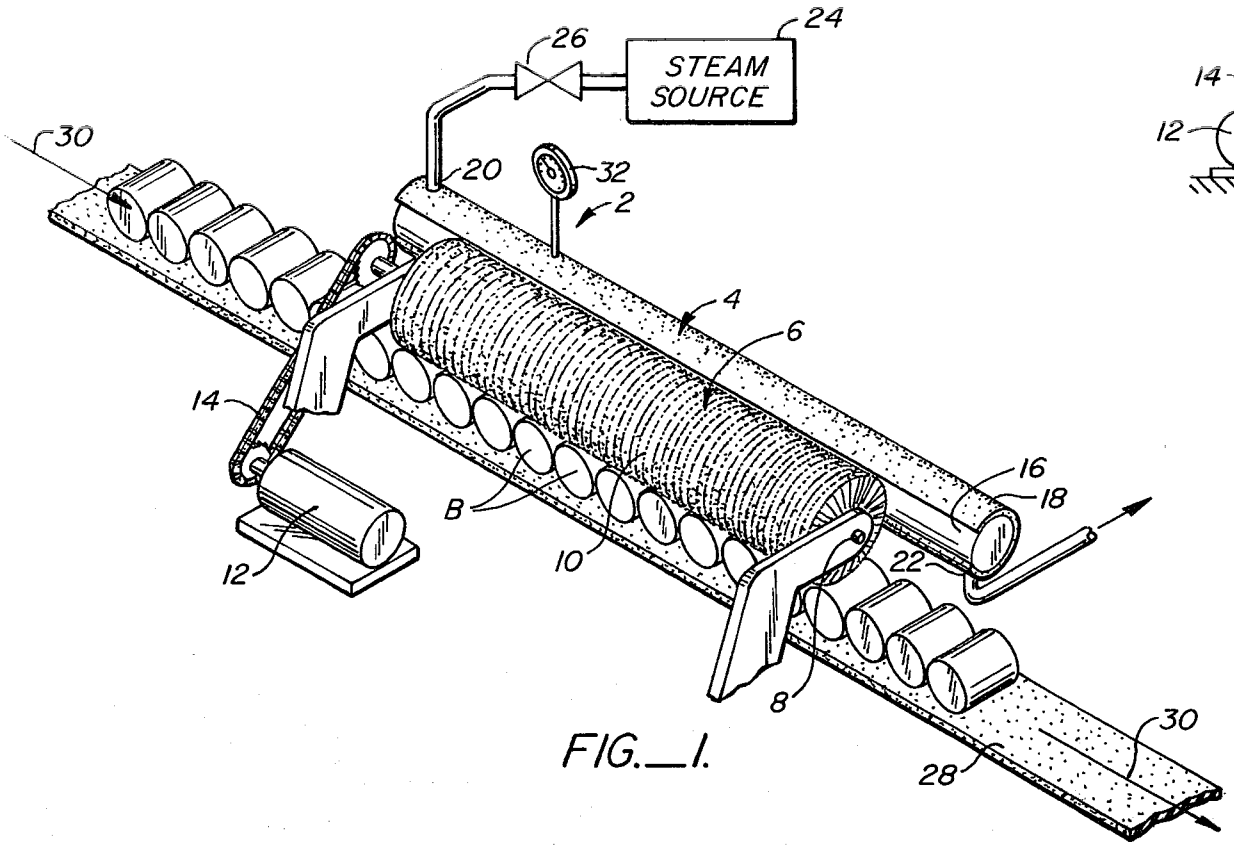
FIG. 1 is a simplified isometric view of the preferred embodiment shown mounted adjacent to a series of bottles passing along a conveyor.

Turning to the Figures, a jar dryer 2 includes generally a heating element 4 mounted adjacent to and longitudinally along a cylindrical rotating brush 6. The brush is mounted above a conveyor 28 so that as a series of jars B pass along the conveyor, the outside ends of the bristles 10 of the brush wipe across the exterior surfaces of the jars as they roll along the conveyor thus removing liquid.

The brush includes a backbone 8 and a plurality of radial bristles 10 extending therefrom. A motor 12 drives the brush via a pulley 14. A ½ horsepower, electric motor has proven sufficient. The rotating brush is of standard commercial design, such as that used in a Dunkley washer dryer.

Heating element 4 includes a metal tube 16 mounted parallel to and touching the outer ends of the bristles of the rotating brush. Tube 16 has an inlet 18 and an outlet 20 provided at opposite ends for the passage of steam. An insulating layer 18 partially surrounds the metal tube, except in the area where the rotating brush contacts the tube. A steam source 24 provides the heating element with a source of steam through a valve 26. A temperature gauge 32 mounted to the tube indicates the temperature of the tube.

The operation of the jar dryer will now be briefly discussed. A series of jars move along the conveyor in the direction of the arrow 30 after first having been washed. When so moved the jars are usually still wet and so are arranged to pass beneath the rotating brush. The outer ends of the bristles of the rotating brush wipe across the exterior surfaces of the jars as they roll along the conveyor. This wiping action removes water from the outer surfaces of the jars in preparation for labeling. If desired, the jars can be passed along the conveyor standing up so any water on their tops would likewise be wiped away. As the brush is rotated, the outer edges of the bristles are heated as they brush across the heater. Heating the bristles helps to dry the brush prior to again wiping the jar surfaces. The heated bristles also warm the jar surfaces to further speed their drying. The temperature of the heating element is varied by changing the amount of steam passing through valve 26. The entire outer surface of each jar is dried because as the jars pass along the conveyor in the usual manner, they are also rolling to expose their entire outer surfaces to the rotating brush. The jar dryer thus accomplishes the dual objects of efficiently and quickly drying a series of jars without the din associated with air compressors, airjets and blowers.

The bristles are further dried by their flexing as they make contact with and disengage from the heating element. This mechanical engagement, and the resulting flexure of the bristles upon disengagement, causes water to be thrown off the ends of the bristles. The stiffness of the bristles, the amount of flexure, the speed of rotation, among other factors, influence the amount of water which is thrown from the bristles in this manner.

In the preferred embodiment the heating element contacts the bristles of the rotating brushes directly; however, other means for heating the bristles, such as focused radiative heat, may also be employed. Although the invention has been described with reference to a jar dryer, the described system may readly be used for drying other objects or series of objects as well. The preferred embodiment has been herein shown and described, however modifications and variations may be made without departing from what is ragarded as the invention.

What is claimed is:

1. A dryer for drying the surface of an object comprising a brush having a plurality of bristles extending from the backbone thereof; means for spinning said brush around its backbone so that a portion of said bristles wipe across the surface of said object to remove liquid from the surface of said object, and means for directly heating at least the outer ends of said bristles as their outer ends traverse the surface of said direct heating means, said direct heating means adapted to engage said bristles so that as said bristles disengage from said surface of said direct heating means said bristles spring back, thus causing liquid to be removed from said bristles, and thereby enhancing the drying performance of said dryer.

2. A system for drying an object comprising:

a conveyor adapted to move a plurality of objects along a path from a loading point to a discharge point, a heating unit supported adjacent to the conveyor path, means for supplying heat to the unit, means for controling the amount of heat supplied to the unit;

a brush member supported adjacent to the conveyor path and arranged to be rotated along a path transverse to conveyor movement, the bristles on the brush adapted to contact the objects on the conveyor to remove liquid from their outer surfaces and also adapted to contact the heating unit; and means for driving the brush so that after its bristles contact the heating unit they contact the objects on the conveyor so that a portion of the heat derived from the heating unit is transferred to the objects on the conveyor to dry the same.

3. A drying system for drying the surface of an object, comprising a brush having a plurality of bristles extending outwardly from its backbone, means to support a series of objects relative to the brush so that only the ends of the brush bristles have standing contact with the object surface, a heating means supported substantially adjacent to the said brush bristles, and means for rotating the brush and placing it so that is partially contacts each of the heating means and the supported brush bristles in sequence, the contact being such that the heat from the heating unit is applied only to the outer ends of the bristles with such ends being flexed when heated so moisture upon the objects is removed by contact and by centrifugal force in the drying performance and the effect of the heat acts as an enhancer of the drying operation.

4. In a dryer for drying the surface of an object with the aid of brush bristles extending externally from the backbone of a brush to the object, a heating unit, bristles extending from the brush surface and adapted to bend at their outer ends when heated, means to hold the bristles in contact with the heating unit and the objects in sequence with contact being maintained between the bristles and the object first on the one hand, and then between the bristles and the heating unit on the other hand, the initial contact between the bristles and the object being sufficient to wipe any moisture from the object but not to dry it, means for rotating the brush so that contact is made with the heating unit so that the ends of the brush bristles are heated, means then to rotate the brush after the bristles are heated at their ends so that those ends will pass over the object prior to the time the bristles are moved away from the object during the operation and the drying operation is enhanced by the applied heat applied to the objects by the bristles making contact therewith.

5. A drying system for drying the surface of an article, comprising a bursh having a plurality of bristles extending outwardly from its backbone, a conveyor adapted to be loaded with the articles to be dried and for moving said articles from an article loading point to an article discharge point, means to support the articles on the conveyor so that the bristles of the brush peripherally can contact the article surface, a heating unit supported adjacent to the conveyor and in contact with a limited portion of the brush bristles so that the heat from the brush may be imparted to the bristles directly with their contact with the heating unit, the brush being located between the conveyor carried articles and the heating unit, means for then rotating the brush so that it next contacts the conveyor carried articles, the contact between the heating unit and the bristles of the brush being sufficient to heat the ends of the bristles and transfer the heat to the articles on the conveyor in such position that the ends of the brush bristles assist the drying operation when contact is made between the brush bristles and the articles on the conveyor, which heating enhances the operation prior to the elasticity of the brush bristles springing back to their original position following contact.

6. A drying system for drying the surface of a series of articles arranged on a conveyor in sequence, comprising a brush having a plurality of bristles extending radially outward from its backbone so that the brush periphery is circular, a heating unit supported substantially adjacent to the conveyor and its carried articles, means for mounting the brush relative to the conveyor and the heating unit thereof such that a portion only of the bristles instantaneously contacts the said unit so that the bristles can be heated, means from the aforesaid brush mounting for holding another portion of the brush bristles instantaneously in contact with the articles on the conveyor, and means for rotating the brush so that the brush bristle contact progresses continually and alternately from the said two states so that the bristles heated by the heating unit pass heat to other articles on the conveyor with brush rotation, and, with heating, causes the moisture to be brushed off prior to the application of drying heat.

7. A drying system for a series of articles claimed in claim 6 which comprises, in addition, a source of steam connected to the heating unit to heat the same, and means to control the pressure of the supplied steam.

8. The drying system claimed in claim 7 comprising, in addition, a metal tube inlet to the heating unit, means for connecting a supply of steam to the said tube, an outlet for the supplied steam, and means to indicate the temperature of the heating unit when supplied with steam from the inlet.

9. The drying system as claimed in claim 8 comprising, in addition, means to cause the bristles to flex as they later brush across the surface of the conveyed articles, whereby, after flexing, the said bristles are straightened to their original form and any liquid on the article surface is thrown off.

10. A method for drying the surface of a series of articles, which comprises conveying a series of articles along a path between a point of loading and a point of discharge, providing a rotatable brush for individually wiping the articles at a point adjacent to the path along which they are conveyed, progressively heating adjacent portions of the brush so that the brush bristles continually acquire heat, moving the articles adjacent to the heating unit, and transferring heat from the brush to the articles along the path of article movement after using the brush bristles to transfer heat to the article from the heating unit.

* * * * *